US008137116B2

(12) United States Patent
Omori et al.

(10) Patent No.: US 8,137,116 B2
(45) Date of Patent: Mar. 20, 2012

(54) GROUND JOINT CONNECTOR AND WIRE HARNESS INCLUDING THE SAME

(75) Inventors: Yasuo Omori, Yokkaichi (JP); Hiroki Hirai, Yokkaichi (JP); Tetsuji Tanaka, Yokkaichi (JP); Masaaki Tabata, Yokkaichi (JP); Yuujirou Imai, Yokkaichi (JP); Teruo Hara, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/143,881

(22) PCT Filed: Aug. 24, 2010

(86) PCT No.: PCT/JP2010/005193

§ 371 (c)(1),
(2), (4) Date: Jul. 8, 2011

(87) PCT Pub. No.: WO2011/030510

PCT Pub. Date: Mar. 17, 2011

(65) Prior Publication Data

US 2011/0269323 A1 Nov. 3, 2011

(30) Foreign Application Priority Data

Sep. 8, 2009 (JP) ..... 2009-207566

(51) Int. Cl.
*H01R 4/66* (2006.01)

(52) U.S. Cl. ..... 439/92; 439/883

(58) Field of Classification Search ..... 439/92, 439/97, 287, 62, 321, 323, 883
See application file for complete search history.

(56) References Cited

U.S. PATENT DOCUMENTS 5,433,628 A * 7/1995 Sadaishi et al. ..... 439/736
(Continued)

FOREIGN PATENT DOCUMENTS

JP U-05-094980 12/1993
(Continued)

OTHER PUBLICATIONS

International Search Report issued in International Patent Application No. PCT/JP2010/005193 Dated Oct. 12, 2010.

*Primary Examiner* — Neil Abrams
*Assistant Examiner* — Harshad Patel
(74) *Attorney, Agent, or Firm* — Oliff & Berridge, PLC

(57) ABSTRACT

The present invention provides a ground joint connector capable of collectively connecting a plurality of grounding wires included in a wire harness for a vehicle, to a given ground site, while occupying a little space. The ground joint connector JC comprises a plurality of wire terminals to be attached to respective terminal ends of the grounding wires, a grounding conductor a connector housing holding the grounding conductor. The grounding conductor includes a plurality of wire-side terminal portions to be fitted to the respective wire terminals in a terminal fitting direction and a ground-side terminal portion to be connected to the ground site while fixed onto the wall surface around the ground site. The wire-side terminal portions aligned in a direction approximately perpendicular to the terminal fitting direction and parallel to the wall surface, and integrally joined to the ground-side terminal portion. The connector housing holds the grounding conductor to allow the ground-side terminal portion to protrude to outside and includes a plurality of terminal receiving chambers and a plurality of terminal locking portions. The terminal locking portions lock the respective wire terminals inserted into the respective terminal receiving chambers and fitted with the respective wire-side terminal portions.

6 Claims, 9 Drawing Sheets

U.S. PATENT DOCUMENTS

| | | | | |
|---|---|---|---|---|
| 6,086,399 | A * | 7/2000 | Matsunaga et al. | 439/287 |
| 6,126,493 | A * | 10/2000 | Price et al. | 439/801 |
| 6,607,392 | B2 * | 8/2003 | Kondoh | 439/92 |
| 6,786,751 | B2 * | 9/2004 | Maeda et al. | 439/287 |
| 6,875,053 | B2 * | 4/2005 | Fujii et al. | 439/567 |
| 7,241,168 | B2 * | 7/2007 | Sakurai et al. | 439/511 |
| 2005/0026480 | A1 * | 2/2005 | Fujii et al. | 439/108 |

FOREIGN PATENT DOCUMENTS

| | | |
|---|---|---|
| JP | A-10-208815 | 8/1998 |
| JP | A-2004-192991 | 7/2004 |
| JP | A-2005-123098 | 5/2005 |

* cited by examiner

GROUND JOINT CONNECTOR AND WIRE HARNESS INCLUDING THE SAME

BACKGROUND OF THE INVENTION

1. Field of the Invention

The present invention relates to a technique for collectively connecting a plurality of grounding wires included in a wire harness for a vehicle to a given ground site inside the vehicle.

2. Description of the Related Art

Heretofore, as a ground connecting device for collectively connecting a plurality of grounding wires included in a wire harness for a vehicle, to a ground site of the vehicle, there has been known a type described in JP 10-208815A.

FIG. 10 shows an outline of this device. The device comprises a harness-side connector 7 to be provided at a terminal end of a wire harness including a plurality of grounding wires, and a ground joint connector 1 to be fixed to a given ground site (in FIG. 10, a bolt 6) provided on a vehicle body 3. The harness-side connector 7 includes a plurality of non-illustrated female terminals to be attached to respective terminal ends of the grounding wires and a connector housing 8 for collectively holding the female terminals. The harness-side connector housing 8 has a plurality of built-in terminal locking portions for holding the female terminals respectively. The ground joint connector 1 includes a grounding conductor 5 and a connector housing 2 which holds the grounding conductor 5, the grounding conductor 5 integrally having a grounding terminal portion 4 to be fixed to the ground site and a plurality of non-illustrated male terminals provided inside the connector housing 2.

According to this device, interconnecting the ground joint connector 1 and the harness-side connector 7 and fixing the grounding terminal portion 4 in the ground joint connector to the bolt 6 as the ground site establish a collective connection of the grounding wires to the ground site. Specifically, the female terminals held by the connector housing 8 of the harness-side connector 7 and the male terminals of the grounding conductor 5 held by the connector housing 2 of the ground joint connector 1 are fitted to each other respectively, thus electrically connecting the grounding wires to which the female terminals are attached to the ground site through the female terminals and the grounding conductor 5; simultaneously, the connector housing 8 of the harness-side connector 7 and the connector housing 2 of the ground joint connector 1 are fitted to each other, and this fitting is locked by engagement between respective engagement portions provided in the two connector housings 8 and 2, the lock keeping the female and male terminals fitted to each other respectively.

However, this ground connecting device, occupying a large space, is difficult to use in a little space in a vehicle. Specifically, the harness-side connector 7 and the ground joint connector 1 of the device require the connector housings 8 and 2 for holding the terminals respectively; furthermore, the connector housings 8 and 2 occupy a large space as a whole for their mutual fitting and the lock of the fitting. To avoid interference between the connector housings 8 and 2 and the vehicle body 3, the connectors 7 and 1 are required to protrude in a large size from an inner surface of the vehicle body 3. Particularly, the case of connecting a grounding terminal 9 attached to an extra grounding wire W to the grounding terminal portion 4 so as to superimpose them to each other as shown in FIG. 10 requires a large gap size L between the vehicle body 3 and each of the connector housings 8 and 2 as shown in FIG. 10, in order to avoid the interference between the grounding terminal and each of the connector housings 8 and 2; this causes the entire device to occupy a larger space.

SUMMARY OF THE INVENTION

It is an object of the present invention to provide a ground joint connector capable of collectively connecting a plurality of grounding wires included in a wire harness for a vehicle to a ground site provided on a wall surface inside the vehicle while occupying only a little space, and a wire harness including the ground joint connector.

Specifically, the ground joint connector of the present invention comprises: a plurality of wire terminals to be attached to respective terminal ends of the grounding wires; a grounding conductor which includes a plurality of wire-side terminal portions each having a shape capable of being fitted to a corresponding one of the wire terminals in a common specific terminal fitting direction, and a ground-side terminal portion having a shape capable of being connected to the ground site while being fixed onto the wall surface, the wire-side terminal portions being aligned in an alignment direction approximately perpendicular to the terminal fitting direction and parallel to the wall surface while integrally joined to the ground-side terminal portion; and a connector housing which holds the grounding conductor and includes a plurality of terminal receiving chambers each having an opening oriented in one direction parallel to the terminal fitting direction and adapted to receive the wire terminals inserted into the terminal receiving chamber through the opening thereof, and a plurality of terminal locking portions adapted to lock the wire terminals inserted into the terminal receiving chambers respectively. The connector housing accommodates the wire-side terminal portions in the respective terminal receiving chambers so as to allow the terminal locking portions to lock the respective wire terminals which are inserted into the respective terminal receiving chambers and fitted with the wire-side terminal portions respectively, and holds the grounding conductor so as to make the ground-side terminal portion protrude to an outside of the connector housing directed oppositely to the openings of the terminal receiving chambers.

The present invention also provides a ground connecting device comprising: the above ground joint connector; and an external grounding terminal to be attached to a terminal end of a second grounding wire other than a plurality of first grounding wires to which the wire terminals of the ground joint connector are attached respectively. The external grounding terminal of the ground connecting device includes a wire-side fixed portion to be fixed to the terminal end of the second grounding wire and a ground-side held portion to be held by a grounding terminal holding portion of the grounding conductor at a position outside the connector housing. The external grounding terminal has such a shape as allows the ground-side held portion to be held by the grounding-terminal holding section under a condition that the second grounding wire is aligned with the first grounding wires in a direction parallel to the alignment direction while extending alongside the connector housing.

Besides, the present invention provides a wire harness comprising: a wire harness body including a plurality of first grounding wires and a second grounding wire having a diameter greater than that of each of the first grounding wires, the first grounding wires and the second grounding wire being bundled together; and the above ground connecting device. In the wire harness, the wire terminals comprised in the ground joint connector of the ground connecting device, while being attached to respective terminal ends of the first grounding wires, are inserted into the respective terminal receiving chambers of the connector housing of the ground joint connector to be fitted with the respective wire-side terminal portions of the grounding conductor of the ground joint connector. The wire-side fixed portion of the external grounding terminal of the ground connecting device is fixed to a terminal end of the second grounding wire, and the ground-side held portion of the external grounding terminal of the ground connecting device is held by the grounding-terminal holding section of the grounding conductor, under a condition that the second grounding wire is aligned with the first grounding wires in a direction parallel to the alignment direction while extending alongside the connector housing.

DESCRIPTION OF EMBODIMENTS

There will be described a preferred embodiment of the present invention with reference to FIGS. 1 to 9.

FIGS. 1 to 4 show a ground connecting device at a terminal end of a wire harness according to this embodiment. The wire harness comprises a wire harness body including a plurality of electric wires bundled together, and the ground connecting device.

Figure 4:
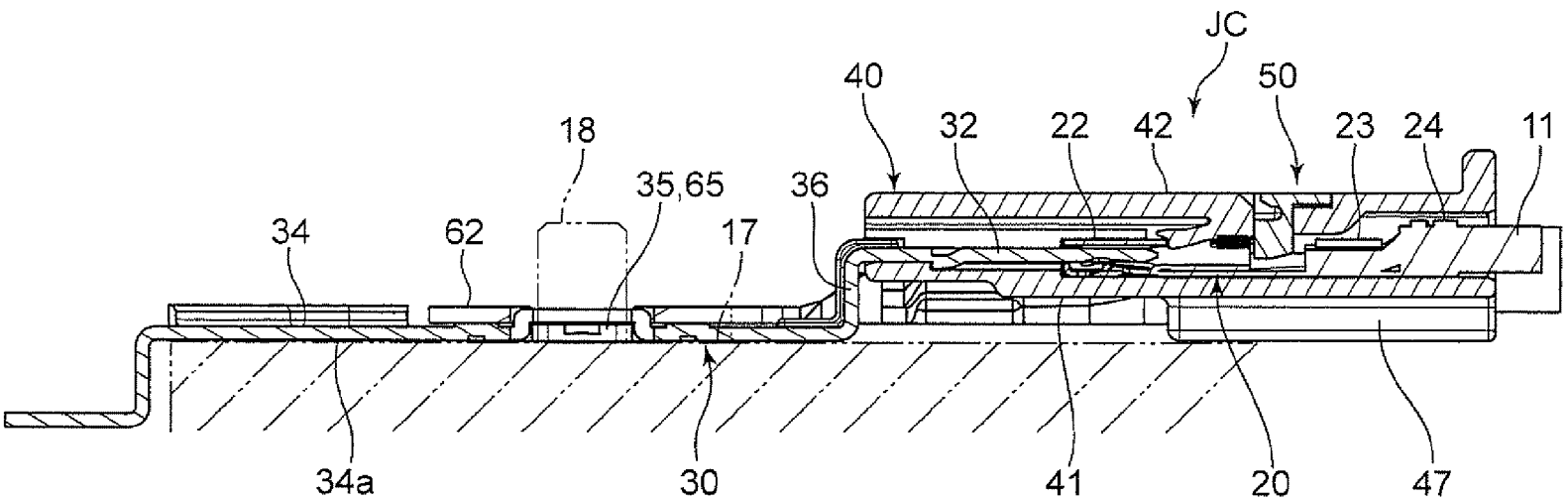
FIG. 4 is a sectional view taken along the line IV-IV in FIG. 2.

As the electric wires constituting the wire harness body, the wire harness includes a plurality of (in the illustrated embodiment, three) first grounding wires 11 and an extra or second grounding wire 12 other than the first grounding wires 11. The grounding wires 11 and 12, each of which is constituted by a conductor 14 and an insulation cover 16 covering the conductor 14, are adapted to be collectively connected to a ground site of a vehicle through the ground connecting device. The ground site is formed of a bolt 18 provided so as to protrude inwardly from a wall surface 17 of a vehicle body, as shown in FIG. 4.

The first grounding wires 11 of the grounding wires 11 and 12 are designed for grounding a specific circuit connected to the wire harness to the ground site, each of the first grounding wires 11 having one end to be connected to the ground site (bolt 18) and the other end to be connected to the circuit. The second grounding wire 12, which is fail-safe for a ground fault due to the occurrence of damage or the like in the ground site, is designed to connect the ground site to an additional ground site. Specifically, the grounding wire 12 has one end to be connected to the ground site and the other end to be connected to a non-illustrated additional ground site, further having an outer diameter greater than that of each of the first grounding wires 11 so as to possess a larger current capacity.

The ground connecting device comprises a ground joint connector JC and an external grounding terminal 60. The ground joint connector JC is designed to collectively connect the first grounding wires 11 to the ground site, and the external ground terminal 60 is provided at a terminal end of the second grounding wire 12 to connect the second grounding wire 12 to the ground site.

The ground joint connector JC comprises a plurality of wire terminals 20, a grounding conductor 30, a connector housing 40, and a retainer 50.

Figure 5A:
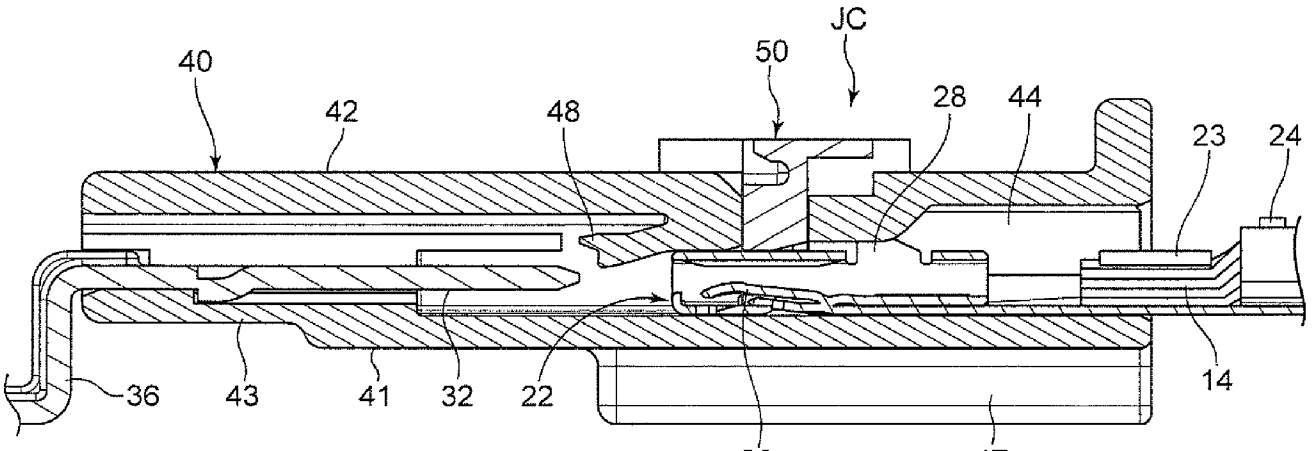
FIG. 5A is a sectional front view showing a retainer of a ground joint connector in the ground connecting device at an insertion/withdrawal permitting position.
Figure 5B:
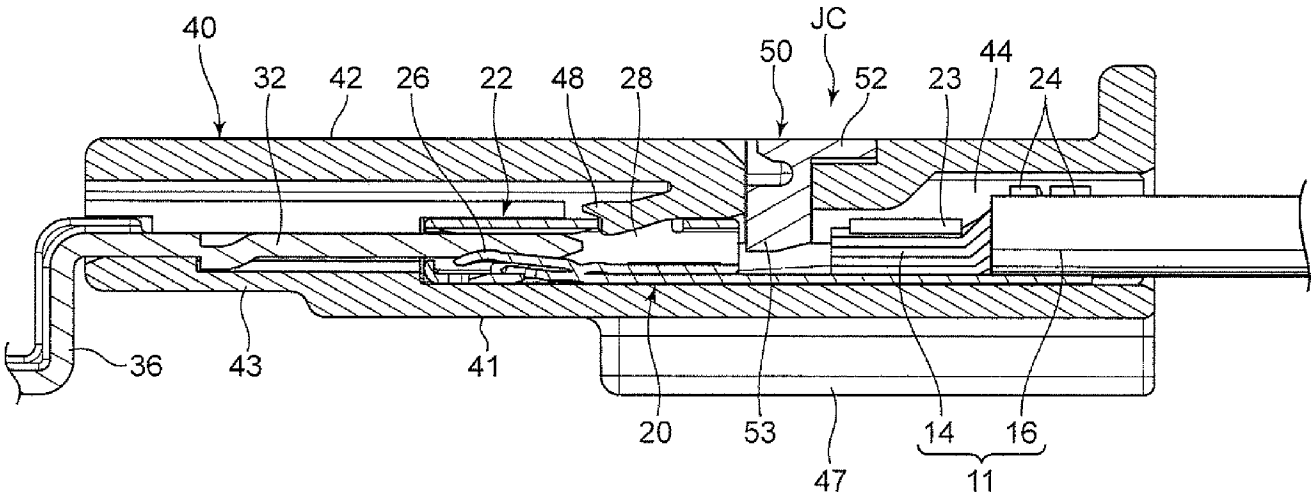
FIG. 5B is a sectional front view showing a state when the retainer is in a lock position.

The wire terminals 20 are to be provided at respective terminal ends of the first grounding wires 11; each of the terminals 20, as also shown in FIGS. 5A and 5B, includes a female-type electric contact portion 22 and a wire-side fixed portion in a front position and a rear position respectively, the wire-side fixed portion comprising a conductor barrel 23 and an insulation barrel 24. The electric contact portion 22 has a hollow rectangular cylindrical-shaped body and a contact spring 26 which is provided inside the body so as to be deflectable. The electric contact portion 22 has a top wall, which is formed with a lockable hole 28 to enable the electric contact portion 22 to be locked to the connector housing 40. The wire-side fixed portion is to be crimped onto the terminal end of a corresponding one of the first grounding wires 11. Specifically, the terminal end of each of the first grounding wire 11 is preliminarily subjected to a partial removal of the insulation cover 16 thereof so as to expose a terminal end of the conductor 14; the barrels 23 and 24 are bended so as to enfold the terminal end of the conductor 14 and a portion of the insulation cover 16 adjacent thereto, respectively, thereby being electrically connected to the conductor.

The grounding conductor 30, which is made of an electrical conductive material, is adapted to be connected to each of the wire terminals 20 to thereby collectively connect the wire terminals 20 to the ground site (bolt 18), that is, collectively ground them. The entire connector housing 40 is integrally molded of an insulating material such as a synthetic resin, into a shape capable of holding a given region of the grounding conductor 30 while accommodating it; specifically, a shape flattened in a thickness direction of the grounding conductor 30.

Figure 6:
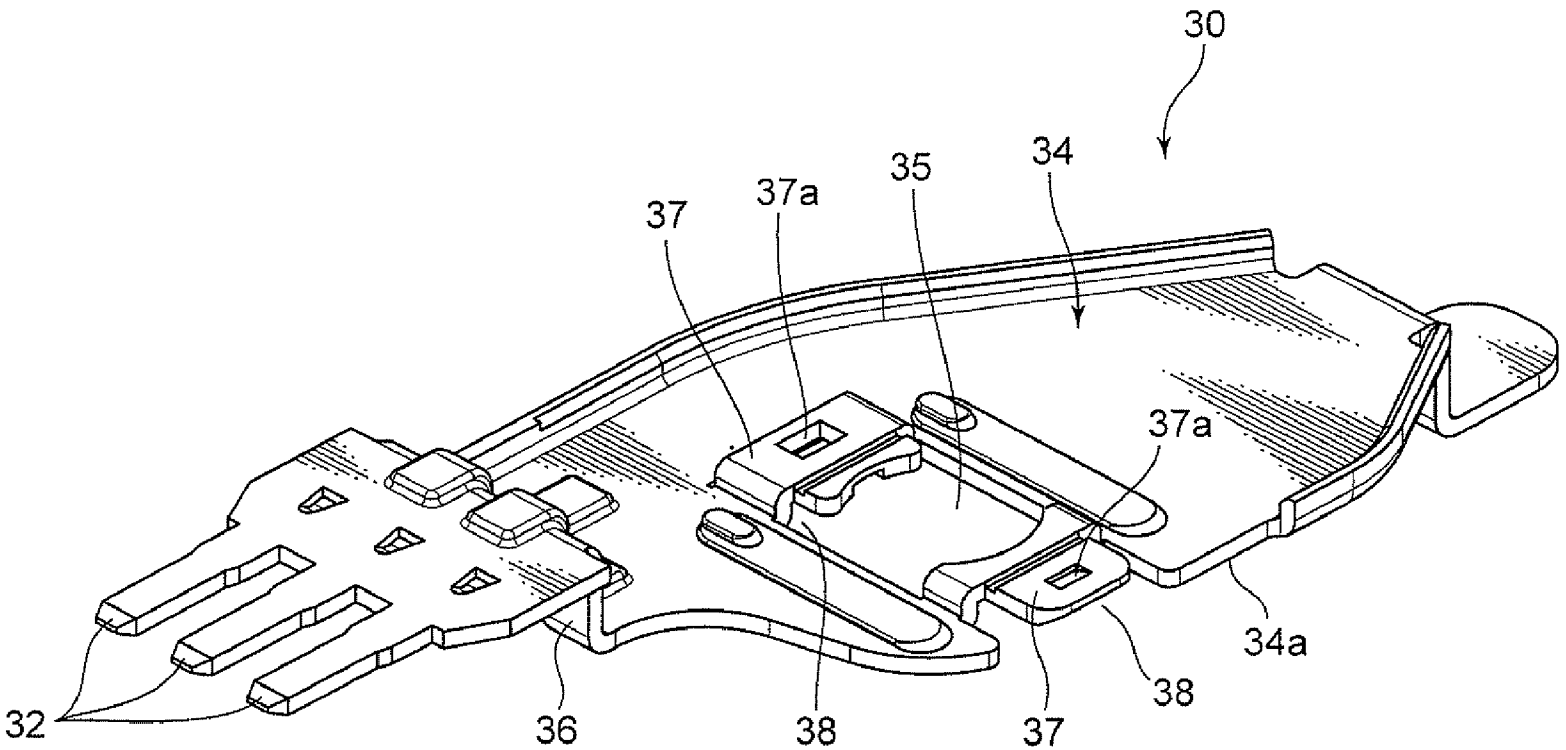
FIG. 6 is a perspective view showing a grounding conductor of the ground connecting device.

The grounding conductor 30, which is formed by stamping a single metal plate into an appropriate shape and bending it in several positions, as also shown in FIG. 6, integrally comprises a plurality of (in the illustrated embodiment, three) wire-side terminal portions 32, a ground-side terminal portion 34, and a stepped portion 36 interposed between the terminal portions 32 and 34; each of the wire-side terminal portions 32 is coupled to the common ground-side terminal portion 34 through the stepped portion 36.

Each of the wire-side terminal portions 32 protrudes toward a rear side (wire side) of the ground joint connector JC to serve as a male-type fitting portion (tab) fittable into the female-type electric contact portion 22 of a corresponding one of the wire terminals 20 in a given direction, a terminal fitting direction (an axial direction of each of the first grounding wires 11); the wire-side terminal portions 32 are adapted to come into press contact with the contact spring 26 and the top wall of the electric contact portion 22 when fitted into the wire terminal 20 to thereby electrically conduct with the electric contact portion 22. The wire-side terminal portions 32 are aligned in a direction parallel to a width direction thereof (a direction perpendicular to the terminal fitting direction and parallel to the wall surface 17). Each of the stepped portion 36 couples a corresponding couple of the wire-side terminal portion 32 and each of the ground-side terminal portion 34 located on a front side of the wire-side terminal portions 32, while providing a given step between the ground-side terminal portion 34 and an arrangement plane of the wire-side terminal portions 32.

The ground-side terminal portion 34 is adapted to be fixed onto the wall surface 17 so as to be connected to the bolt 18, the ground site, while serving a function of holding the external grounding terminal 60. Specifically, the ground-side terminal portion 34 is of plate shape along the wall surface 17, having a wall-side fixed surface 34 which is an underside plane surface able to be fixed onto the wall surface 17. The ground-side terminal portion 34 has a through-hole 35 formed at an appropriate position thereof (in the illustrated embodiment, at a position offset from the wire-side terminal portions 32 in the width direction parallel to an alignment direction of the wire-side terminal portions 32) to allow the bolt 18 to be inserted thereinto, and further has a grounding-terminal holding section 37 for holding the external grounding terminal 60 on right and left sides of the through-hole 35 (opposite sides of the through-hole 35 in the width direction). The grounding-terminal holding section 37 is raised upwardly beyond the remaining section of the ground-side terminal portion 34 to form a space 38 (FIG. 6), into which the external grounding terminal 60 is to be fitted, on an under side (back side) of the ground-side terminal portion 34.

The connector housing 40 holds the wire-side terminal portions 32 so as to expose the ground-side terminal portion 34 of the grounding conductor 30, while having a shape flattened in a direction perpendicular to the alignment direction of the wire-side terminal portions 32. The connector housing 40 includes: a back-side surface 41 to be opposed to the wall surface 17 when the ground-side terminal portion 34 is fixed to the wall surface 17; and a front-side surface 42 reverse to the back-side surface 41. In this embodiment, each of the two surfaces 41 and 42 is a flat surface approximately parallel to the wall surface 17. The back-side surface 41 has a plurality of line-shaped protrusions 47 protruding therefrom in such a protrusion size that the protrusions 47 keep a gap corresponding to the step of the stepped portion 36 between the back-side surface 41 and the wall surface 17.

The connector housing 40 has a front portion (ground-side portion) as a conductor holding portion 43, and a rear portion (wire-side portion) including a plurality of (in the illustrated embodiment, three) terminal receiving chambers 44. The terminal receiving chambers 44 are aligned in a direction parallel to the alignment direction of the wire-side terminal portions 32 at the same pitch as that of the wire-side terminal portions 32, each of the terminal receiving chambers 44 having an opening on the rear side, i.e., on a side opposite to the ground-side terminal portion 34. Through the opening, the electric contact portion 22 of a corresponding one of the wire terminals 20 is inserted into the terminal receiving chambers 44. The conductor holding portion 43 has a shape into which each of the wire-side terminal portions 32 of the grounding conductor 30 can be press-fitted from a side opposite to the terminal receiving chambers 44 (the front side), thus holding the press-fitted wire-side terminal portion 32. Each of the wire-side terminal portions 32 is held in such a position that the wire-side terminal portion 32 protrudes into a corresponding one of the terminal receiving chambers 44 and is able to be fitted with the electric contact portion 22 of the wire terminal 20 inserted into the terminal receiving chamber 44 in an insertion direction of the wire terminal 20 (terminal fitting direction).

As shown in FIGS. 5A and 5B, the connector housing 40 is formed with a plurality of lances 48 each serving as a terminal locking portion, at respective positions corresponding to the terminal receiving chambers 44. Each of the lances 48 bulges obliquely inwardly inside the terminal receiving chamber 44 from a top surface (upper surface) of the terminal receiving chambers 44, the lance 48 having a distal end which serves as a free end capable of being deflected in a thickness direction of the connector housing 40 (in the illustrated embodiment, vertically deflected). The distal end is adapted to be deflected upwardly by contact with the inserted wire terminals 20 so as to allow the wire terminals 20 to pass through the distal end and thereafter elastically return to its regular position to fall into the lockable hole 28 of the wire terminal 20 as shown in FIG. 5B to restrain the wire terminals 20 from the rear side. In other words, the distal end is adapted to block the displacement of the wire terminals 20 in a withdrawal direction thereof to thereby lock (primarily lock) the wire terminals 20 in a position where the wire terminals 20 is fitted with the wire-side terminal portion 32.

The retainer 50, which is designed to additionally lock (secondarily lock) each of the wire terminals 20 having been fitted with the wire-side terminal portion 32 and locked by the lance 48, is attached to an intermediate portion of the connector housing 40 in a front-rear direction. In detail, the retainer 50 is attached to the connector housing 40 movably, in the thickness direction of the connector housing 40 (in a direction approximately perpendicular to both of the alignment direction of the wire-side terminal portions 32 and the terminal fitting direction), between an insertion/withdrawal permitting position shown in FIG. 5A and a lock position such that the retainer 50 sinks into the connector housing 40 under the insertion/withdrawal permitting position, as shown in FIG. 5B; the retainer 50 permits the wire terminals 20 to be inserted into and withdrawn from the respective terminal receiving chambers 44, at the insertion/withdrawal permitting position, while locking the wire terminals 20 inserted into the respective terminal receiving chambers 44 to be fitted to the respective wire-side terminal portions 32, at the lock position.

Figure 7:
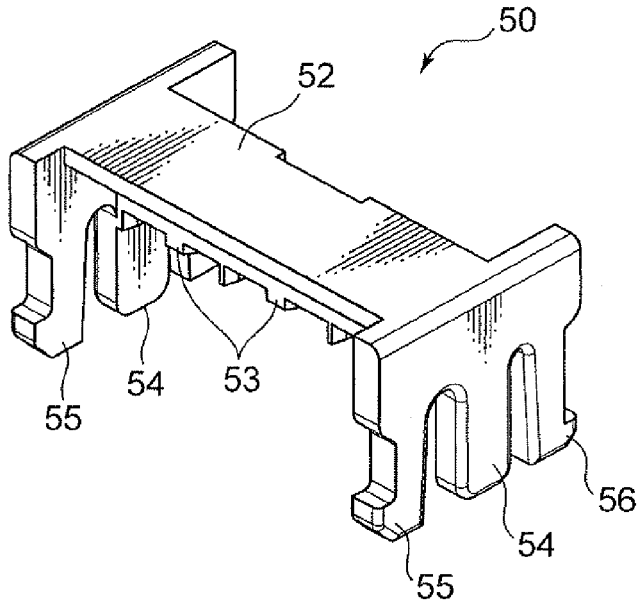
FIG. 7 is a perspective view of the retainer.

As shown in FIG. 7, the retainer 50 has a top wall 52 extending in a width direction of the connector housing 40 (a direction parallel to the alignment direction of the wire-side terminal portions 32) and a pair of sidewalls 54 extending downwardly from the opposite ends of the top wall 52 respectively. The top wall 52 is formed with a plurality of locking protrusions 53 at respective positions corresponding to the terminal receiving chambers 44, in a back-side surface of the top wall 52. The locking protrusions 53 are retracted upwardly (to a front side) from the respective terminal receiving chambers 44 to permit the wire terminals 20 to be inserted from and withdrawn from the terminal receiving chambers 44, when the retainer 50 is in the insertion/withdrawal permitting position; the locking protrusions 53 protrude into the respective terminal receiving chambers 44 to restrain the respective electric contact portions 22 of the wire terminals 20 at the rear side thereof to thereby double-lock the wire terminals 20, when the retainer 50 is pushed to the lock position while the wire terminals 20 has been inserted into the respective terminal receiving chambers 44 to be locked by the respective lances 48. Each of the sidewalls 54 is formed with a pair of front and rear lockable pieces, namely, a temporarily lockable piece 55 and a fully lockable piece 56. Each of the temporarily lockable piece 55 and the fully lockable piece 56 is of a cantilever shape having an upper end connected to a central region of the sidewall 54 and a lower end serving as a free end deflectable in the front-rear direction of the connector housing 40. The lockable pieces 55 and 56 have a temporarily lockable protrusion 55*a* and a fully lockable protrusion 56*a*, respectively, which protrude outwardly in a front-rear direction, in the respective lower ends of the lockable protrusions 55*a* and 56*a*.

Figure 8A:
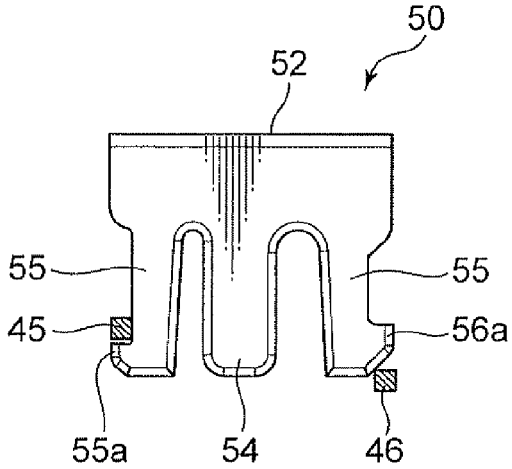
FIG. 8A is a partially sectional front view showing the retainer temporarily locked at the insertion/withdrawal permitting position.
Figure 8B:
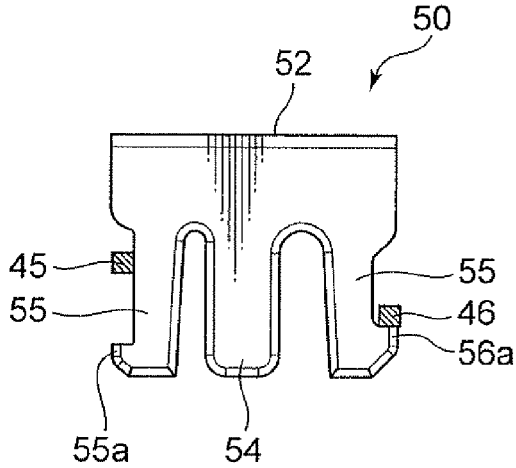
FIG. 8B is a partially sectional front view showing the retainer fully locked at the lock position.

In the connector housing 40, there is formed a pair of insertion grooves 49 (FIG. 1) into which the respective sidewalls 54 of the retainer 50 is inserted from the upper side thereof, and there exist a pair of front and rear locking protrusions, namely, a temporarily locking protrusion 45 and a fully locking protrusion 46, in each of the insertion grooves 49, as shown in FIGS. 8A and 8B. The temporarily locking protrusion 45 is provided at such a height position that it constrains the temporarily lockable piece 55*a* on the upper side thereof to lock (temporarily lock) the retainer 50 in the insertion/withdrawal permitting position, as shown in FIG. 8A. The fully locking protrusion 46 is provided at such a height position that it constrains the fully lockable piece 56*a* from thereabove to lock (fully lock) the retainer 50 in the lock position below the insertion/withdrawal permitting position, as shown in FIG. 8B.

The lock position of the retainer 50 is set to such a position that an upper surface of the top wall 52 of the retainer 50 is flush with the front-side surface 42 of the connector housing 40, as shown in FIGS. 1 to 4 and FIG. 5B, or sinks inward of the connector housing 40 (in the illustrated embodiment, downwardly) beyond the front-side surface 42. On the other hand, the insertion/withdrawal permitting position of the retainer 50 is set to such a position that the top wall 52 protrudes outwardly (in the illustrated embodiment, upwardly) beyond the front-side surface 42, as shown in FIG. 5A.

The external grounding terminal 60 has a wire-side fixed portion to be fixed to the terminal end of the second grounding wire 12 and a terminal body portion 62 to be held so as to be superimposed on the ground-side terminal portion 34 of the grounding conductor 30 at a position outside the connector housing 40.

The wire-side fixed portion has a pair of conductor barrels 63 and a pair of insulation barrels 64. The conductor barrels 63 are crimped onto the conductor 14 of the second grounding wire 12 so as to enfold the conductor 14. The insulation barrels 64 are crimped onto the insulation cover 16 of the second grounding wire 12 so as to enfold the insulation cover 16.

The terminal body portion 62 has a through-hole 65 at a position aligned with the through-hole 35 of the ground-side terminal portion 34, while having a ground-side held portion 67 capable of entering the back of the grounding-terminal holding section 37 (i.e., entering the space 38 (FIG. 6) on a back side of the grounding-terminal holding section 37). The ground-side held portion 67 is formed with a lockable protrusion 67*a* in an front-side surface (upper-side surface) thereof, while the grounding-terminal holding section 37 is formed with a locking hole 37*a*. The lockable protrusion 67*a* and the locking hole 37*a* make an engagement with each other, the engagement enabling the grounding-terminal holding section 37 to lock the ground-side held portion 67 to thereby inhibit the terminal body portion 62 from a relative displacement (particularly, a relative rotation) to the ground-side terminal portion 34.

Figure 1:
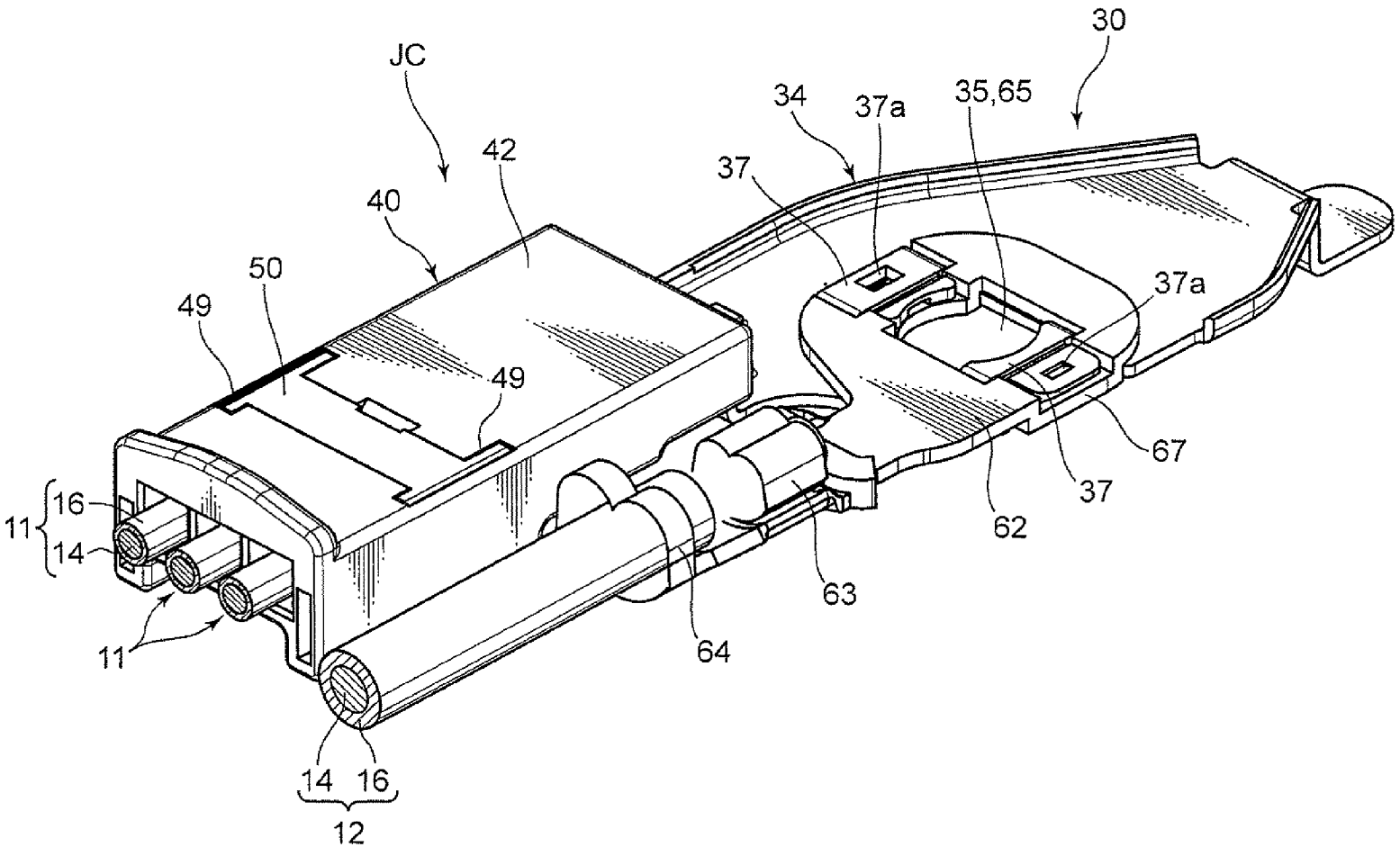
FIG. 1 is an exploded perspective view showing a structure of a ground connecting device at a terminal end of a wire harness according to one embodiment of the present invention.
Figure 2:
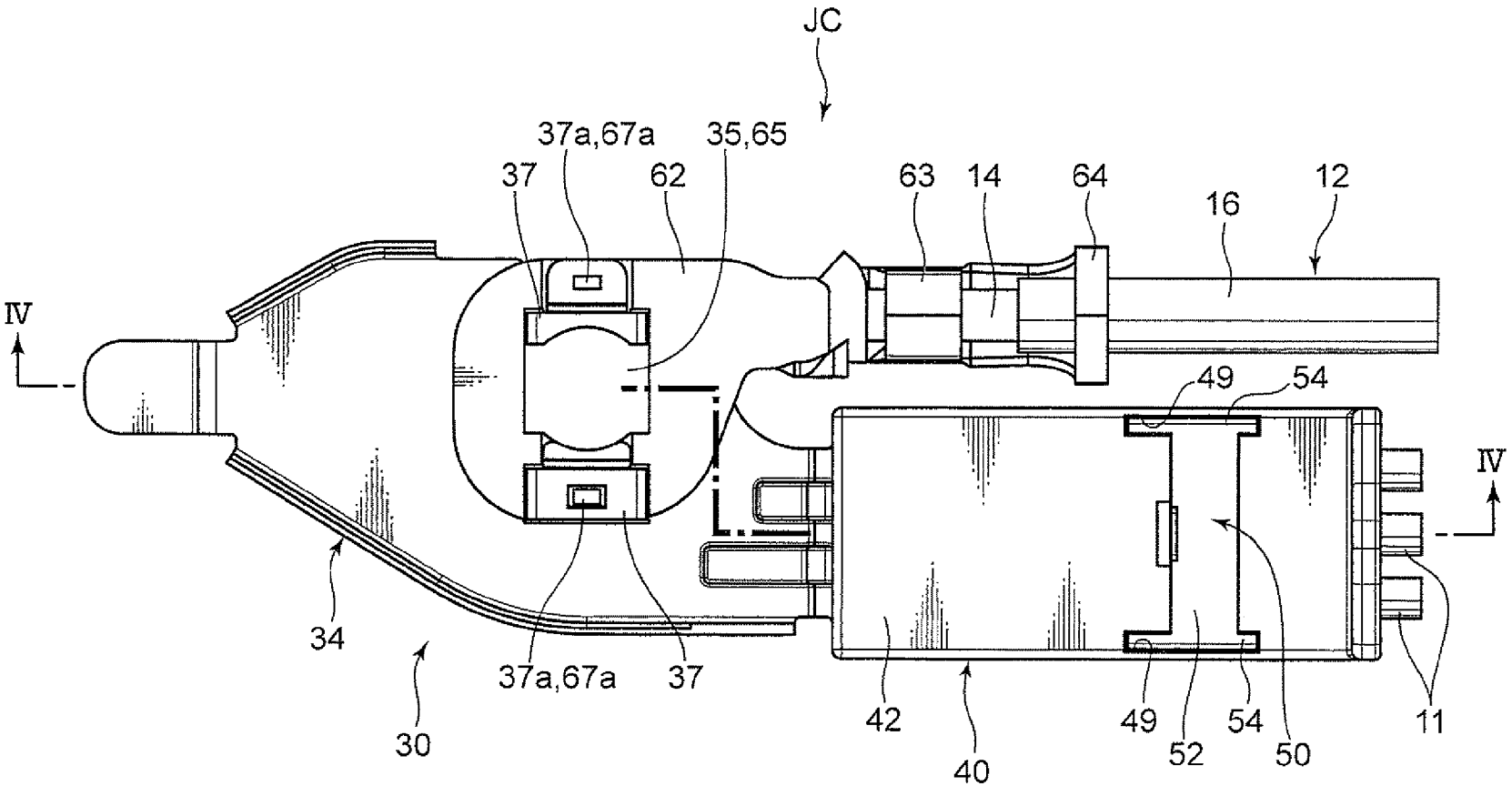
FIG. 2 is a top plan view of the ground connecting device.
Figure 3:
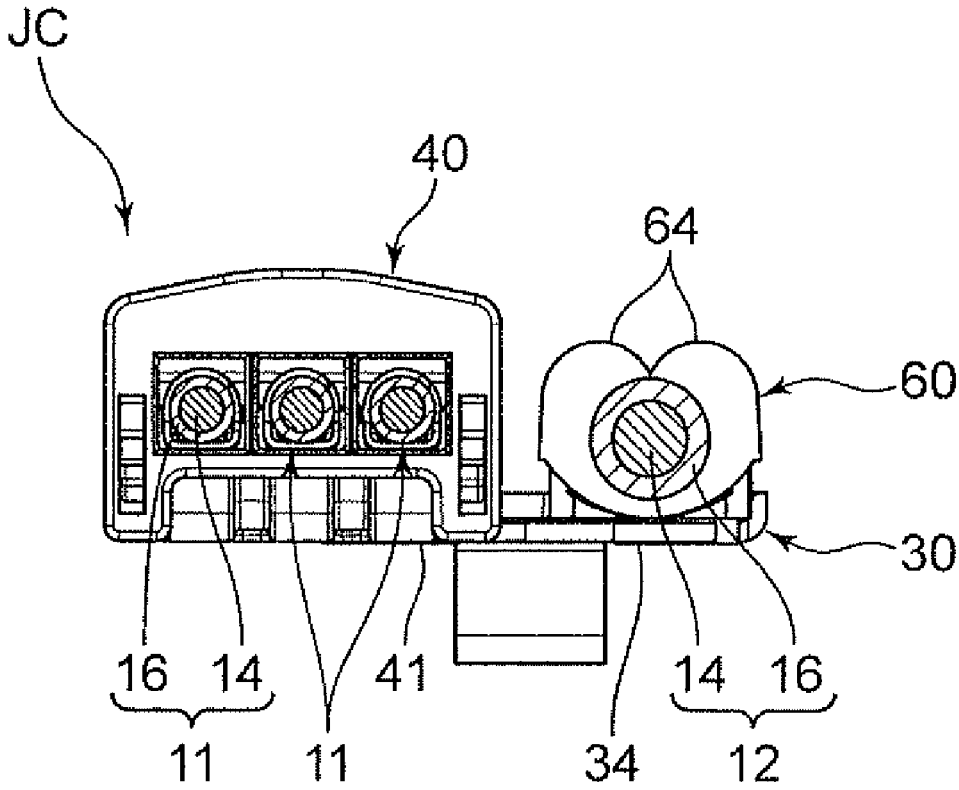
FIG. 3 is a partially sectional side view of the ground connecting device.

The external grounding terminal 60 has a shape as shown in FIG. 3, specifically, a shape which allows the ground-side held portion 67 to be held by the grounding-terminal holding section 37 in a condition that the second grounding wire 12 to which the external grounding terminal 60 is attached is aligned with the first grounding wires 11 in a width direction of the ground joint connector parallel to the alignment direction of the wire-side terminal portions 32 while extending alongside the connector housing 40.

Next will be described a procedure of assembling of the ground connecting device and a procedure of ground connection by use of the ground connecting device.

1) Attachment of Terminals 20 and 60 to Electric Wires 11 and 12

The plurality of first grounding wires 11 and the second grounding wire 12 to be grounded are extracted from the wire harness body. The wire terminals 20 of the ground joint connector JC are attached to the respective terminal ends of the first grounding wires 11, while the external grounding terminal 60 is attached to the terminal end of the second grounding wire 12. The attachment of the above terminals may be performed in advance of assembly of the wire harness.

2) Attachment of Retainer 50

The retainer 50 of the ground joint connector JC is attached to the connector housing 40. Specifically, both of the sidewalls 54 of the retainer 50 are half way inserted into the respective insertion grooves 49 of the connector housing 40, thereby being temporarily locked in the insertion/withdrawal permitting position shown in FIGS. 5A and 8A, i.e., in such a position that the temporarily lockable protrusion 55*a* of the temporarily lockable piece 55 has climbed over the temporarily locking protrusion 45 of the connector housing 40 while the fully lockable protrusion 56*a* of the fully lockable piece 56 has not yet climbed over the fully locking protrusion 46.

3) Insertion of Wire terminals 20

Each of the wire terminals 20 is inserted into a corresponding one of the terminal receiving chambers 44 of the connector housing 40 to be fitted to a corresponding one of the wire-side terminal portions 32 while passing under a corresponding one of the locking protrusions 53 of the retainer 50 in the insertion/withdrawal permitting position, which enables the wire terminals 20 to be collectively and electrically connected to the common grounding conductor 30. Upon the fitting, the lances 48 (i.e., terminal locking portions) of the connector housing 40 are fitted into the respective lockable holes 28 provided in the electric contact portions 22 of the wire terminals 20 to lock (primarily lock) the electric contact portions 22, thereby keeping the electric contact portions 22 and the wire-side terminal portions 32 fitted with each other respectively.

4) Secondary Lock by Retainer 50

Following the above primary lock, the retainer 50 is further pushed in, in the thickness direction of the connector housing 40 (i.e., a direction approximately perpendicular to both of the alignment direction of the wire-side terminal portions 32 and the terminal fitting direction), so that the fully lockable protrusion 56*a* of the fully lockable piece 56 climbs over the fully locking protrusion 46 of the connector housing 40 involving the deflection of the fully lockable piece 56, thereby fully locking the retainer 50 at the lock position as shown in FIG. 5B and FIG. 5B. The locking protrusions 53 of the top wall 52 of the retainer 50 at the lock position enter the respective terminal receiving chambers 44 to constrain the electric contact portions 22 of the wire terminals 20 at the rear side, thereby secondarily locking the wire terminals 20. This makes it possible to reliably keep the wire terminals 20 and the wire-side terminal portions 32 inside the connector housing 40 fitted with each other respectively, without an extra wire terminal-holding housing other than the connector housing 40 as provided in the conventional ground connecting device.

5) Uniting External Grounding Terminal 60

The terminal body portion 62 of the external grounding terminal 60 is united to the ground-side terminal portion 34 of the grounding conductor 30 to thereby making an electrical connection with the ground-side terminal portion 34. Specifically, the ground-side held portion 67 of the external grounding terminal 60 is fitted into the under side of the grounding-terminal holding section 37 of the ground-side terminal portion 34 so as to fit the lockable protrusion 67*a* of the ground-side held portion 67 into the locking hole 37*a* of the grounding-terminal holding section 37, thereby being held by the grounding-terminal holding section 37. The ground connecting device is thus built up at a terminal end of the wire harness.

6) Connection to Ground Site

The ground-side terminal portion 34 and the external grounding terminal 60 thus united are collectively connected to the ground site, i.e., bolt 18 and fixed to it. Specifically, the fixing surface 34*a* of the ground-side terminal portion 34 is faced to the wall surface 17 in an area around the bolt 18 so that the bolt 18 penetrates through the through-hole 35 and the through-hole 65 provided in the ground-side terminal portion 34 and the external grounding terminal 60 respectively, and thereafter a non-illustrated nut is screwed on to the bolt 18 and fastened. The ground-side terminal portion 34 is thereby fixed between the nut and the wall surface 17, while grounding the first grounding wires 11 through the grounding conductor 30 including the ground-side terminal portion 34 and the wire terminals 20 fitted to the wire-side terminal portions 32 of the grounding conductor 30 and also grounding the second grounding wire 12 through the external grounding terminal 60 superimposed on the ground-side terminal portion 34.

Figure 10:
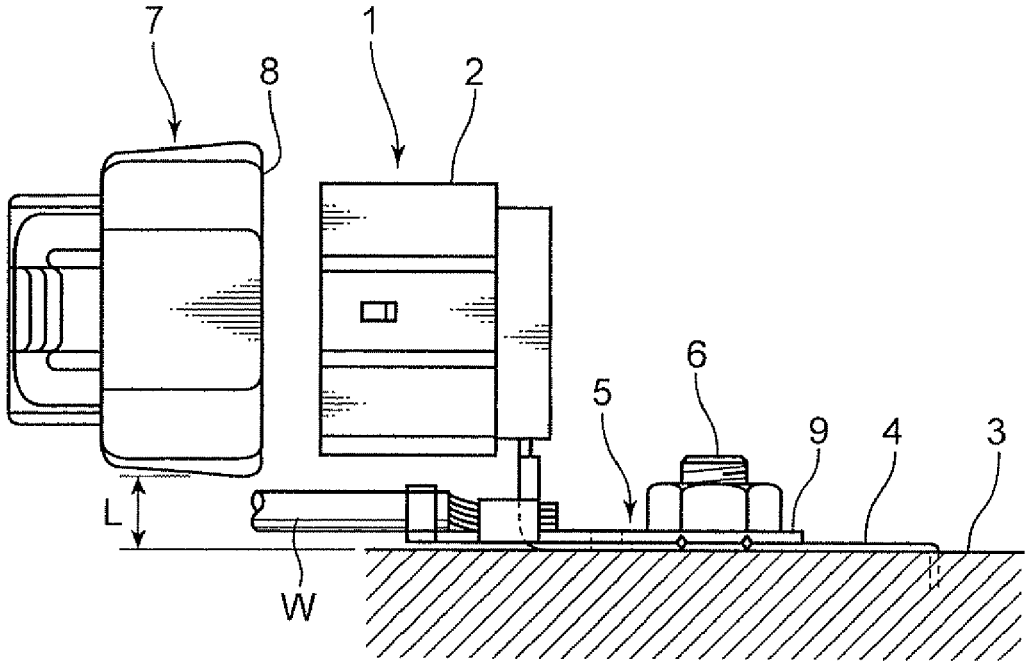
FIG. 10 is a front view showing a conventional ground connecting device.

The above ground connecting device is able to connect the first grounding wires 11 to the ground site through the wire terminals 20 and the grounding conductor 30 based on only the connector housing 40 holding the grounding conductor, not requiring the dedicated connector housing 8 for collectively holding the wire terminals as shown in FIG. 10, and keep the connection based on the locks by the lances 48 of the connector housing 40 and the retainer 50 attached to the connector housing 40.

Furthermore, the alignment of the wire-side terminal portions 32 of the grounding conductor 30 in a direction approximately parallel to the fixing surface 34*a* of the ground-side terminal portion 34, i.e., a planar surface to be fixed onto the wall surface 17 of the vehicle, allows the ground joint connector JC to protrude from the wall surface 17 in only reduced size. The present invention, however, does not exclude that the wire-side terminal portions 32 are aligned in a direction perpendicular to the wall surface 17, in addition to a direction parallel to the wall surface 17. For example, the wire-side terminal portions 32 may form two lines in a direction perpendicular to the fixing surface 34*a*, each line including three or more of the wire-side terminal portions 32 aligned in a direction approximately parallel to the fixing surface 34*a*. However, the limitation of the alignment direction of the wire-side terminal portions 32 to a direction approximately parallel to the wall surface 17 (in the above embodiment, a direction approximately parallel to the fixing surface 34*a*) allows the ground joint connector JC to protrude within further reduced size from the wall surface 17.

Moreover, the above ground connecting device, differently from the device illustrated in FIG. 10, has no necessity for avoiding interference between the second grounding wire 12 to which the external grounding terminal 60 is attached and another connector housing prepared only for holding the wire terminals 20, and allows the second grounding wire 12 to extending alongside the connector housing 40 of the ground joint connector JC so as to be aligned with the first grounding wires 11 in a direction parallel to the alignment direction of the wire-side terminal portions 32; which enables the entire device to have a more flattened structure so as to protrude in further reduced size from the wall surface of the vehicle.

The wire harness according to the present invention, however, may be devoid of the second grounding wire 12 and the external grounding terminal 60 to be attached to the second grounding wire 12.

On the other hand, since the switching of the position of the retainer 50 between the insertion/withdrawal permitting position and the lock position is performed based on the displacement of the retainer 50 in a direction approximately perpendicular to both of the alignment direction of the wire-side terminal portions 32 and the terminal fitting direction, i.e., a direction approximately perpendicular to the fixing surface 34*a*, the state of the retainer 50 can be switched between a state of locking all of the wire terminals 20 and a state of permitting the insertion/withdrawal of the wire terminals 20, by only a small displacement of the retainer, as compared with the case where the displacement is performed in a direction parallel to the alignment direction of the wire-side terminal portions 32 (that is, a width direction of the connector).

Furthermore, in response to an operation of the retainer 50 between the insertion/withdrawal permitting position and the lock position, the top wall 52 of the retainer 50 protrudes or sinks with respect to the front-side surface 42 of the connector housing 40 (i.e., a surface on an opposite side of the back-side surface 41 opposed to the wall surface 17), thus enabling an operator to easily re-check the accomplishment of the lock of the wire terminals 20 by the retainer 50, according to a protrusion state of the retainer 50 with respect to the front-side surface 42, for example, when the ground-side terminal portion 34 is fixed onto the wall surface 17 of the vehicle.

Figure 9:
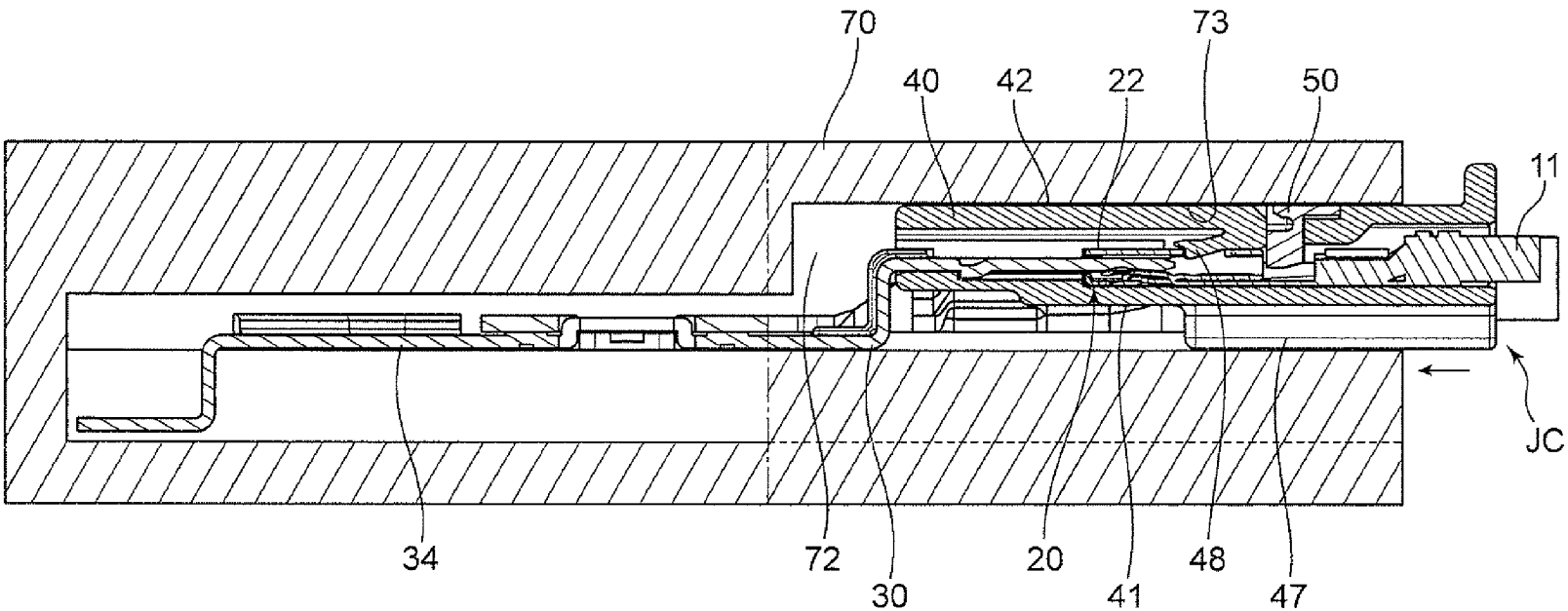
FIG. 9 is a sectional front view showing a retainer position-inspecting jig into which the ground joint connector is inserted.

In the ground joint connector JC whose retainer 50 thus protrudes or sinks with respect to the front-side surface 42 of the connector housing 40 depending on the position thereof, the inspection on an adequacy of the double locking can be easily performed, for example, by use of a jig 70 as shown in FIG. 9. This jig 70 has a connector insertion hole 72 having an opening oriented in a specific direction, through which opening the joint connector JC to be inspected can be inserted into the connector insertion hole 72 so as to let the ground-side terminal portion 34 thereof be ahead. The connector insertion hole 72 has a shape corresponding to that of the joint connector JC when viewed from the side of the ground-side terminal portion 34. In the connector insertion hole 72, a region for receiving the connector housing 40 inserted thereinto has a top surface 73 at a height position corresponding to the front-side surface 42 of the connector housing 40.

The jig 70 allows an adequacy of double locking of wire terminals 20 by a retainer 50 to be automatically determined based on whether the joint connector JC can be inserted into the connector insertion hole 72. Specifically, the retainer 50, when positioned in the lock position as shown in FIG. 9, i.e., a position flush with or below the front-side surface 42, permits the connector housing 40 to be entirely inserted into the connector insertion hole 72. On contract, the retainer 50, when stopped in the insertion/withdrawal permitting position where it protrudes outwardly from the front-side surface 42, for example, as shown in FIG. 5A, without sinking to the lock position, conflicts with the jig 70 to thereby prevent the connector housing 40 from full insertion into the connector insertion hole 72. This enables the adequacy of double locking by the retainer 50 to be determined based on the possibility of the insertion.

The retainer 50 is also not absolutely essential in the present invention, but may be appropriately omitted.

As described above, the present invention provides a ground joint connector capable of collectively connecting a plurality of grounding wires included in a wire harness for a vehicle to a ground site provided on a wall surface inside the vehicle, while occupying only a reduced space, and a wire harness including the ground joint connector.

Specifically, the ground joint connector which the present invention provides comprises: a plurality of wire terminals to be attached to respective terminal ends of the grounding wires; a grounding conductor which includes a plurality of wire-side terminal portions each having a shape capable of being fitted to a corresponding one of the wire terminals in a common specific terminal fitting direction, and a ground-side terminal portion having a shape capable of being connected to the ground site while being fixed onto the wall surface, the wire-side terminal portions being aligned in an alignment direction approximately perpendicular to the terminal fitting direction and parallel to the wall surface while integrally joined to the ground-side terminal portion; and a connector housing which holds the grounding conductor and includes a plurality of terminal receiving chambers each having an opening oriented in one direction parallel to the terminal fitting direction and adapted to receive the wire terminals inserted into the terminal receiving chamber through the opening thereof, and a plurality of terminal locking portions adapted to lock the wire terminals inserted into the terminal receiving chambers respectively. The connector housing accommodates the wire-side terminal portions in the respective terminal receiving chambers so as to allow the terminal locking portions to lock the respective wire terminals which are inserted into the respective terminal receiving chambers and fitted with the wire-side terminal portions respectively, and holds the grounding conductor so as to make the ground-side terminal portion protrude to an outside of the connector housing directed oppositely to the openings of the terminal receiving chambers.

This ground joint connector, while occupying only a little space, is able to connect a plurality of grounding wires included in a wire harness for a vehicle, to a ground site of the vehicle. Specifically, in the above ground joint connector, the wire terminals attached to the respective terminal ends of the grounding wires are directly inserted the respective receiving chambers of the connector housing holding the grounding conductor to be fitted with the respective wire-side terminal portions of the grounding conductor, and locked by the respective terminal locking portions provided in the connector housing to thereby be kept fitted; therefore, the connector housing holding can connect the wire terminals to the ground site through the grounding conductor and keep the fitting state of the wire terminals by the terminal locking portions locking the respective wire terminals, even by no use of a dedicated connector housing for collectively holding the wire terminals such as shown in FIG. 10. Furthermore, the wire-side terminal portions of the grounding conductor, being aligned in a direction approximately parallel to the wall surface of the vehicle to which the ground-side terminal portion is to be fixed, allows the ground joint connector to protrude in only reduced size from the wall surface.

The ground joint connector of the present invention, preferably, further comprises a retainer for additionally locking the wire terminals having been fitted with the respective wire-side terminal portions and locked by the respective terminal locking portions of the connector housing. More preferably, the retainer is attached to the connector housing movably, in a direction approximately perpendicular to both of an alignment direction of the wire-side terminal portions and the terminal fitting direction, between an insertion/withdrawal permitting position for permitting each of the wire terminals to be inserted into and withdrawn from the respective terminal receiving chambers and a lock position for locking each of the wire terminals in such a position that the wire terminal has been inserted into the terminal receiving chamber and fitted with the wire-side terminal portion.

This retainer can reliably keep the wire terminals and the wire-side terminal portions fitted to each other respectively to thereby ensure high connection reliability, in spite of the direct insertion of the wire terminals into the connector housing of the ground joint connector with no use of the dedicated connector housing. In addition, the displacement direction of the retainer, which is a direction approximately perpendicular to both of the alignment direction of the wire-side terminal portions and the terminal fitting direction, allows the retainer to be switched between a state of locking all of the wire terminals and a state of permitting the insertion/withdrawal of the wire terminals by a small displacement of the retainer, as compared with the case where the displacement direction is parallel to the alignment direction of the wire-side terminal portions.

In this case, the connector housing preferably has a back-side surface to be faced to the wall surface of the vehicle to which the ground-side terminal portion is to be fixed, and a front-side surface on an opposite side of the back-side surface, wherein the lock portion is a position where the retainer is flush with the front-side surface or sink toward an inside of the connector housing under the front-side surface and the insertion/withdrawal permitting position is a position where the retainer protrudes outwardly beyond the front-side surface. In this ground joint connector, when the ground-side terminal portion is fixed onto the wall surface of the vehicle, a part of the retainer protrudes or sinks with respect to the front-side surface of the connector housing, thus enabling the check whether the wire terminals are adequately locked by the retainer to be easily performed according to a protruding state of the retainer from the front-side surface.

Preferably, in the ground joint connector of the present invention, the ground-side terminal portion of the grounding conductor has a grounding-terminal holding section adapted to hold an external grounding terminal attached to a terminal end of an extra grounding wire other than the grounding wires to which the respective wire terminals are attached, so as to let the external grounding terminal be superimposed on and brought into contact with the ground-side terminal portion at a position outside the connector housing.

The present invention also provides a ground connecting device comprising: the above ground joint connector; and an external grounding terminal adapted to be attached to a terminal end of a second grounding wire other than the first grounding wires of the ground joint connector to which wires the respective wire terminals are attached. In the ground connecting device, the external grounding terminal includes a wire-side fixed portion to be fixed to the terminal end of the second grounding wire and a ground-side held portion held by the grounding-terminal holding section of the grounding conductor at a position outside the connector housing, the external grounding terminal having such a shape as allows the ground-side held portion to be held by the grounding-terminal holding section, under a condition that the second grounding wire is aligned with the first grounding wires in a direction parallel to the alignment direction of the wire-side terminal portions while extending alongside the connector housing.

This ground connecting device allows a space to be kept alongside the connector housing of the ground joint connector by omission of a dedicated connector housing for holding the wire terminals (wire-side connector housing) in the conventional device; the effective utilization of the space enables the second grounding wire other than the grounding wires (first grounding wires) to which the respective wire terminals are attached to be aligned with the first grounding wires in a direction parallel to the alignment direction of the wire-side terminal portions. This allows the structure of the entire device to be further flatten to thereby enable the device to protrude in only further reduced size from the wall surface of the vehicle.

The present invention also provides a wire harness comprising: a wire harness body including a plurality of first grounding wires and a second grounding wire having a diameter greater than that of each of the first grounding wires, the first grounding wires and the second grounding wire being bundled together; and the above ground connecting device. In the wire harness, each of the wire terminals included in the ground joint connector of the ground connecting device is inserted into the respective terminal receiving chambers of the connector housing of the ground joint connector to be fitted with the respective wire-side terminal portions of the grounding conductor of the ground joint connector, while being attached to respective terminal ends of the first grounding wires; the wire-side fixed portion of the external grounding terminal of the ground connecting device is fixed to a terminal end of the second grounding wire; and the ground-side held portion of the external grounding terminal of the ground connecting device is held by the grounding-terminal holding section of the grounding conductor, under a condition that the second grounding wire is aligned with the first grounding wires in a direction parallel to the alignment direction of the wire-side terminal portions while extending alongside the connector housing.

This wire harness can connect both of the first grounding wires and the second grounding wires included therein, to the common ground site, while having a terminal end with a simple structure and a flat shape.

What is claimed is:

1. A ground joint connector provided in a wire harness to collectively connect a plurality of grounding wires included in the wire harness, to a ground site provided on a wall surface inside a vehicle, the ground connector comprising:

a plurality of wire terminals to be attached to respective terminal ends of the grounding wires;

a grounding conductor which includes a plurality of wire-side terminal portions each having a shape capable of being fitted to a corresponding one of the wire terminals in a specific terminal fitting direction, and a ground-side terminal portion having a shape capable of being connected to the ground site while being fixed onto the wall surface, the wire-side terminal portions being aligned in a direction approximately perpendicular to the terminal fitting direction and parallel to the wall surface and integrally joined to the ground-side terminal portion; and a connector housing which holds the grounding conductor and includes a plurality of terminal receiving chambers each having an opening oriented in one direction parallel to the terminal fitting direction and adapted to receive the wire terminals inserted into the terminal receiving chamber through the opening thereof, and a plurality of terminal locking portions adapted to lock the wire terminals inserted into the terminal receiving chambers respectively, wherein the connector housing accommodates the wire-side terminal portions in the respective terminal receiving chambers so as to allow the terminal locking portions to lock the respective wire terminals which are inserted into the respective terminal receiving chambers and fitted with the wire-side terminal portions respectively, and holds the grounding conductor so as to make the ground-side terminal portion protrude to an outside of the connector housing directed oppositely to the openings of the terminal receiving chambers.

2. The ground joint connector as defined in claim 1, further comprising a retainer for additionally locking the wire terminals fitted with the respective wire-side terminal portions and locked by the respective terminal locking portions of the connector housing, the retainer being attached to the connector housing movably, in a direction approximately perpendicular to both of an alignment direction of the wire-side terminal portions and the terminal fitting direction, between an insertion/withdrawal permitting position for permitting each of the wire terminals to be inserted into and withdrawn from the respective terminal receiving chambers and a lock position for locking each of the wire terminals in a position where the wire terminal has been inserted into the terminal receiving chamber and fitted with the wire-side terminal portion.

3. The ground joint connector as defined in claim 2, wherein the connector housing has a back-side surface to be faced to the wall surface of the vehicle to which the ground-side terminal portion is to be fixed and a front-side surface on an opposite side of the back-side surface, and wherein the lock portion is a position where the retainer is flush with the front-side surface or sink toward an inside of the connector housing under the front-side surface and the insertion/withdrawal permitting position is a position where the retainer protrudes outwardly beyond the front-side surface.

4. The ground joint connector as defined in claim 1, wherein the ground-side terminal portion of the grounding conductor has a grounding-terminal holding section adapted to hold an external grounding terminal attached to a terminal end of an extra grounding wire other than the grounding wires to which the respective wire terminals are attached, so as to let the external grounding terminal be superimposed on and brought into contact with the ground-side terminal portion at a position outside the connector housing.

5. A ground connecting device for collectively connecting a plurality of grounding wires included in a wire harness to a ground site provided on a wall surface inside a vehicle, comprising:

the ground joint connector as defined in claim 4; and an external grounding terminal to be attached to a terminal end of a second grounding wire which is one of the grounding wires included in the wire harness and other than the first grounding wires to which the respective wire terminals of the ground joint connector are attached, wherein the external grounding terminal includes a wire-side fixed portion to be fixed to the terminal end of the second grounding wire and a ground-side held portion to be held by the grounding-terminal holding section of the grounding conductor at a position outside the connector housing, the external grounding terminal having such a shape as allows the ground-side held portion to be held by the grounding-terminal holding section, under a condition that the second grounding wire is aligned with the first grounding wires in a direction parallel to the alignment direction of the wire-side terminal portions while extending alongside the connector housing.

6. A wire harness comprising:

a wire harness body including a plurality of first grounding wires and a second grounding wire having a diameter greater than that of each of the first grounding wires, the first grounding wires and the second grounding wire being bundled together; and the ground connecting device as defined in claim 5, wherein:

the wire terminals comprised in the ground joint connector of the ground connecting device are inserted into the respective terminal receiving chambers of the connector housing of the ground joint connector to be fitted with the wire-side respective terminal portions of the grounding conductor of the ground joint connector, while being attached to respective terminal ends of the first grounding wires; and the wire-side fixed portion of the external grounding terminal of the ground connecting device is fixed to a terminal end of the second grounding wire; and the ground-side held portion of the external grounding terminal of the ground connecting device is held by the grounding-terminal holding section of the grounding conductor, under a condition that the second grounding wire is aligned with the first grounding wires in a direction parallel to the alignment direction of the wire-side terminal portions while extending alongside the connector housing.

* * * * *